US007146685B2

(12) United States Patent
Bevenhall et al.

(10) Patent No.: US 7,146,685 B2
(45) Date of Patent: Dec. 12, 2006

(54) PROCESS AND ARRANGEMENT FOR PRODUCING AIRBORNE FIBERS

(75) Inventors: Kary Bevenhall, Angered (SE); Tommy Ohlsson, Göteborg (SE)

(73) Assignee: SCA Hygiene Products AB, Gothenburg (SE)

( * ) Notice: Subject to any disclaimer, the term of this patent is extended or adjusted under 35 U.S.C. 154(b) by 81 days.

(21) Appl. No.: 10/609,564

(22) Filed: Jul. 1, 2003

(65) Prior Publication Data

US 2004/0094643 A1 May 20, 2004

Related U.S. Application Data

(60) Provisional application No. 60/393,117, filed on Jul. 3, 2002.

(51) Int. Cl.
*D01G 1/00* (2006.01)
*D01G 37/00* (2006.01)

(52) U.S. Cl. ..... 19/0.3; 19/0.6

(58) Field of Classification Search ..... 19/0.3, 19/0.35, 0.37, 0.39, 0.6, 65 R, 66.2, 66.1, 19/66 T, 65 T, 65 CR, 150, 157; 241/34; 428/373; 225/93; 83/913, 950
See application file for complete search history.

(56) References Cited

U.S. PATENT DOCUMENTS 3,017,684 A * 1/1962 Pittman ..... 28/167
3,126,584 A * 3/1964 Pearson ..... 19/0.51
3,334,532 A * 8/1967 Mylo ..... 83/18
3,334,533 A * 8/1967 Davis, Jr. ..... 83/100
3,353,431 A * 11/1967 Mylo ..... 83/116
3,653,094 A 4/1972 Fairfield
4,014,231 A * 3/1977 Hutzezon ..... 83/100
4,266,323 A * 5/1981 Waugh ..... 19/0.56
4,315,347 A 2/1982 Austin et al.
4,355,438 A * 10/1982 Reeves et al. ..... 19/0.51
4,369,549 A * 1/1983 Sanders ..... 19/145.7
5,836,225 A * 11/1998 Molnar et al. ..... 83/100
6,182,332 B1 * 2/2001 Jander ..... 19/60
6,477,740 B1 * 11/2002 Hansen ..... 19/0.35

FOREIGN PATENT DOCUMENTS

BE 795871 A * 2/1973
GB 2 124 264 A 2/1984
WO 93/11288 6/1993

* cited by examiner

*Primary Examiner*—Gary L. Welch
(74) *Attorney, Agent, or Firm*—Buchanan Ingersoll & Rooney PC

(57) ABSTRACT

A process for producing a flow of airborne fibers includes feeding a continuous length (2) of a thread bundle of fiber material from a stock (1) of fiber material through a roll press (4) which rotates at a rate of feed and with the thread bundle held fast in the nip between its rollers (11, 12), breaking off individual fibers from the thread bundle by means of a tearer (5), and carrying away the individual fibers broken off by the tearer by means of an air flow.

22 Claims, 2 Drawing Sheets

PROCESS AND ARRANGEMENT FOR PRODUCING AIRBORNE FIBERS

CROSS-REFERENCE TO RELATED APPLICATIONS

The present application claims the benefit of U.S. Provisional Application No. 60/393,117, filed in the United States on Jul. 3, 2002, the entire contents of which are hereby incorporated herein by reference.

BACKGROUND OF THE APPLICATION

1. Technical Field

The present invention relates to a process and an arrangement for producing airborne fibers from continuous lengths of thread bundles of fiber material.

2. Description of Related Art

In the manufacture of absorbent articles such as diapers, incontinence pads, sanitary towels and the like, a number of different types of material are used made up of various types of synthetic fibers. The materials most commonly encountered are various types of so-called non-woven materials, which are mainly used as liquid-permeable surface layers of absorbent articles. The liquid-permeable surface layers are arranged on that side of the article which in use is turned towards the user. Another common type of material made up of synthetic fibers are so-called waddings, which is a material placed directly inside the liquid-permeable surface layer of the absorbent article and functioning as a first temporary storage material for the liquid getting into the article.

There are also other applications of synthetic fiber material in absorbent articles.

The basic material for the manufacture of synthetic fiber material for absorbent articles are continuous lengths of thread bundles (tow rope), which are cut to predefined lengths in a separate process before the non-woven material or the wadding can be manufactured. WO-A1-93/11288 shows an arrangement for feeding thread bundles of synthetic fiber material to a cutting arrangement in which the thread bundles are cut to specific lengths.

The cut fibers are then normally baled for delivery to a manufacturer of non-woven material or wadding material.

Regardless of whether they go for non-woven manufacture or wadding manufacture, the fibers in the fiber bales are separated from one another in a first stage, following which the fibers are fed into a manufacturing process in which a so-called fiber layer is created. A common technique for creating a fiber layer is carding. The fiber layer is finally tied together by a suitable method, giving the non-woven material or the wadding its strength so that it can be handled and the material can be introduced into a machine for manufacturing absorbent articles, wound up on to a roll or the like.

Attempts have also been made to introduce fibers from fiber bales into an air flow and create a fiber layer on a vacuum wire, a so-called mat-former. The mat forming technique is a considerably easier and more robust technique than carding.

However, the mat-forming technique has proved to be too rough and insensitive and major problems have occurred when the fibers in the bale must be separated from one another without forming fiber flocks. Fiber flocks give rise to an uneven non-woven material or wadding material which does not function satisfactorily and is not aesthetically acceptable. The strength of the finished uneven material is also a problem.

There is therefore a need for a process and an arrangement, which from a continuous length of a thread bundle of fiber material can produce airborne fibers with an even distribution of fibers in the air flow without a significant incidence of fiber flocks in the air flow, so that the robust mat-forming technique can be used in the creation of a fiber layer.

OBJECTS AND SUMMARY

It is an object of the present invention is to meet this need.

According to one embodiment of the invention, a process for producing a flow of airborne fibers, includes the following stages:

a) a continuous length of a thread bundle of fiber material is fed from a stock of fiber material through a roll press, which rotates at a rate of feed and with the thread bundle held fast in the nip between its rollers, b) on emerging from the roll press, individual fibers are broken off from the thread bundle by means of a tearer, and c) the individual fibers broken off by the tearer are carried away from the tearer by means of an air flow.

This process has proved to give a substantially more even distribution of fibers in the air flow, while the incidence of fiber flocks in the air flow is, by and large, negligible compared to previously known robust mat-forming processes. However, the distribution is not necessarily more even than the sensitive carding process.

In a preferred embodiment the tearer comprises a rotating tearer and the tearer is rotated at a peripheral speed greater than 600 m/min, preferably greater than 1200 m/min and more preferably greater than 1500 m/min. The length of the airborne fibers is adjusted by varying the distance between the roll press and the tearer and the quantity of airborne fibers is adjusted by varying the speed of rotation of the roll press, that is to say by adjusting the input feed rate of the thread bundle.

An embodiment of the invention also relates to an arrangement for producing airborne fibers having a defined length distribution from a thread bundle of fiber material, wherein the arrangement comprises a stock of fiber material in the form of continuous lengths of thread bundles, a roll press with an inlet side for thread bundles and an outlet side, a tearer arranged adjacent to the outlet side of the roll press, a housing, which encloses the tearer and which comprises an opening on the side facing the outlet side of the roll press, and an air inlet and an air outlet arranged on opposite sides of the housing, and an element for producing an air flow through the housing from the air inlet to the air outlet.

In a preferred embodiment, the rollers in the roll press have a series of axial ribs evenly distributed along the circumference of the rollers and extending over the entire length of the rollers, the ribs on the one roller engaging in the intervals between the ribs on the second roller as the rollers rotate. The tearer preferably takes the form of a rotating tear roller and the arrangement advantageously has elements for moving the roll press in a radial direction relative to the tear roller. The element for producing an air flow through the housing from the air inlet to the air outlet may comprise a blower, the outlet side of which is connected to the air inlet of the housing.

BRIEF DESCRIPTION OF THE DRAWINGS

The invention will now be described with reference to drawings attached, of which.

DETAILED DESCRIPTION OF PREFERRED EMBODIMENTS

Figure 1:
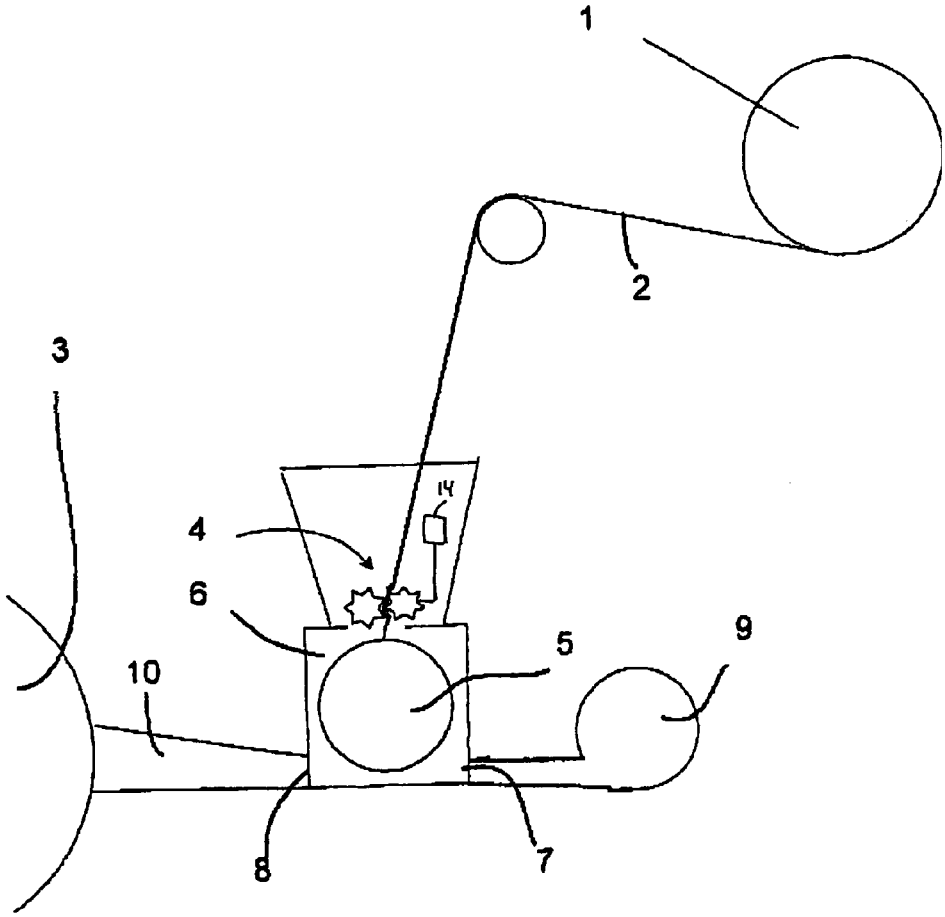
FIG. 1 shows a diagrammatic side view of an arrangement according to a preferred embodiment of the invention connected to a mat-former wheel.

FIG. 1 shows a diagram of a preferred embodiment for air-depositing a layer of synthetic fibers, taken from a storage reel 1 of a continuous length 2 of a thread bundle of such fibers, a so-called tow rope, on to a mat-former 3. Such layers of fibers are suitable as insert layer in absorbent products, such as sanitary towels, diapers and the like. The arrangement comprises a roll press 4, which feeds the thread bundle length 2 to a tearer 5, such as a tearer from Zuiko, for example. Means 14 are provided for moving the roll press 4 radially in relation to the tear roller 5. The tearer 5 is located inside a housing 6, which has an inlet feed opening, through which the tow rope 2 runs. The housing furthermore has an air inlet 7 and air outlet 8 arranged in two opposite walls, which in the embodiment shown extend at right angles to the wall containing the inlet feed opening. The outlet side of the blower 9 is connected to the air inlet 7 of the housing and an outlet funnel 10 extends from the air outlet 8 of the housing to just outside the peripheral surface of the mat-former 3. Alternative locations of the air inlet and air outlet are also conceivable.

Figure 2:
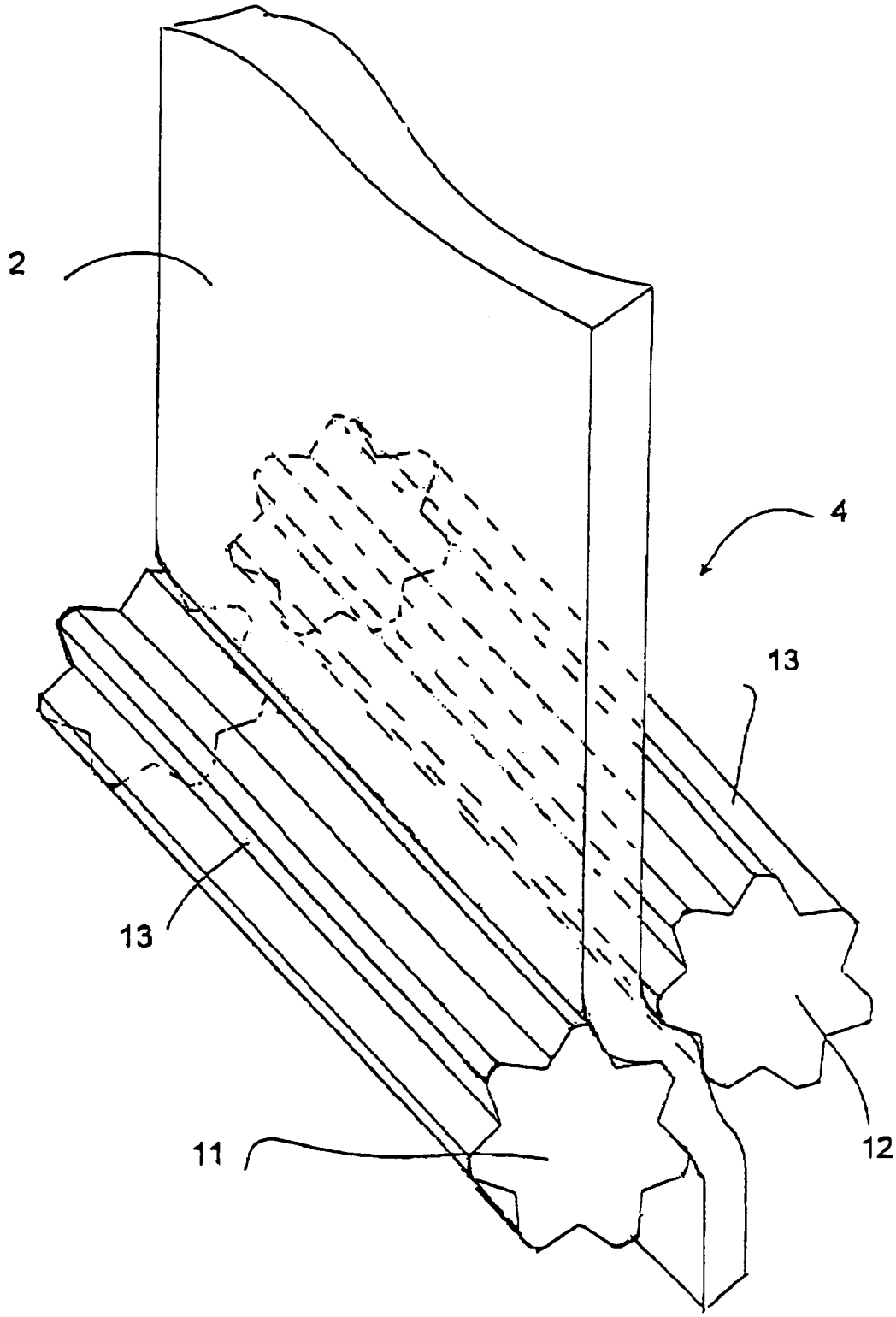
FIG. 2 shows a diagrammatic perspective view of the roll press forming part of the arrangement according to FIG. 1, and, FIG. 3 shows the shape of the teeth in the tearer forming part of the arrangement according to FIG. 1.

FIG. 2 shows a diagrammatic perspective view of the roll press 4. As will be seen from this figure, the rollers 11, 12 forming part of this roll press have ribs running axially, which extend over the entire length of the rollers and are evenly distributed along the circumference of the rollers. The rollers 11, 12 are furthermore arranged so that, as the rollers rotate, the ribs 13 of one roller extend in intervals between the ribs 13 of the second roller. The bearing surface between the tow rope and the peripheral surfaces of the rollers will thereby be relatively large while the tow rope winds through the roll nip between the rollers 11, 12 in the roll press 4. The tow rope is thereby held so hard between the rollers that the fibers are torn off without the tow rope slipping between the rollers.

Figure 3:
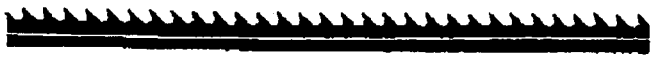

The tearer 5, shown in diagrammatic form in FIG. 1, comprises a rotatable cylindrical tearer of a type similar to that used in carding of fiber material. Such a tearer has a toothed, continuous wire wound around the periphery of the cylinder over the entire length of the cylinder. The wire is wound such that adjacent turns of the wire are preferably in contact with each other. FIG. 3 shows a typical profile of such a wire. The wire has a width of 0.5–1 mm, which means that the inclination of the wire turns in the transverse direction of the cylinder produced by the winding will be relatively small. Such a tearer typically has between 60 and 120 tooth points/cm$^2$. During operation of the arrangement, the tearer 5 rotates with a high speed so that the peripheral speed far exceeds the rate of feed of the tow rope. The peripheral speed of the tearer is greater than 600 m/min, preferably greater than 1200 m/min and more preferably greater than 1500 m/min. The high peripheral speed of the tearer means that the tow rope is not drawn off but broken/torn off.

The arrangement functions so that the teeth of the tearer take hold of the tow rope, which is being fed out from the roll nip between the rollers 11, 12, and tear off the threads in the tow rope. Because the tearer has a high tooth density, individual fibers will be torn off. The fibers torn off are then blown off the teeth of the tearer and transported away by the air flow generated by the blower 9 through the outlet funnel 10 to the mat-former wheel 3, the fibers being collected in the air-permeable molds, which extend along the periphery of the mat-former wheel. A negative pressure normally prevails under the bases of these molds.

Due to the fact that the peripheral speed of the tearer is much higher than that of the rollers 11, 12, the tow rope may be regarded as stationary in relation to the tearer at the instant of tearing. The threads of the tow rope are moreover held securely fast in the roll nip between the rollers 11, 12, so that they cannot slip in relation to the rollers or be stretched in the roll nip.

After passing through the roll press 11, 12, the continuous fiber threads are exposed to the air flow caused by the high speed of rotation of the tearer 5. The air flow deflects the fibers in the direction of the air flow and each individual fiber oscillates freely to and fro in the air flow until it encounters the teeth of the tearer. The length of each individual fiber thread when it encounters one of the teeth of the tearer varies, and depends primarily on how long the fiber thread in question can oscillate freely in the air flow from the tearer 5 before it encounters the surface of the tearer 5, that is to say the time it spends in the housing 6.

Important parameters that affect the time spent by the individual fiber threads before they are encountered by the tearer 5 and hence their length are the distance between the roll press 11, 12 and the tearer 5, the speed of rotation of the tearer 5 and the strength of the air flow formed thereby, the inlet feed speed of the roll press 11, 12 and variations in the stiffness of different fiber threads.

When one of the teeth of the tearer finally encounters the fiber thread, the fiber thread is broken off at the point of impact due to the great force and the rapid sequence with which the tearer 5 acts on the fiber thread.

The length of a fiber torn off therefore depends on a number of parameters, but the most important of these is the more or less random parameter of how much time it spends in the housing 6 without being encountered by the tearer 5.

With regards to the fiber length distribution, the fibers torn off can be divided into three main categories.

The first category comprises fiber threads that are relatively short. These short fibers have been torn off from the continuous thread bundle, that is to say encountered by the tearer 5 after spending a relatively short time in the housing 6. The category contains an estimated 25% of the total proportion of fibers torn off.

The second category, representing approximately 50% of the fibers torn off, consists of fibers that have been torn off from the thread bundle after a slightly longer length of time.

The third category consists of longer fibers with greater variations in length. A relatively longer time has probably elapsed before the tearer managed to take hold of these fibers. The proportion of fibers in this third category is approximately 25% of the total quantity of fibers. This mixing of longer fibers has a positive impact on the quality of the fiber layer to be created, since a certain admixture of the long fibers acts as effective reinforcement for the fiber layer created.

Typical fiber lengths in category one (short fibers) are 5–40 mm, in category two 40–70 mm and in category three 70–150 mm (polyester fibers).

Other fiber length distributions can naturally also be produced by modifying the distance between the rollers 11, 12 and the tearer.

In certain applications it may be advantageous to produce greater fiber length variations than the natural variations described above, which can be achieved in a number of ways.

One way is to make the diameter of the tearer 5 vary over its axial extent, so that the distance between the roll press 11, 12 and the tearer 5 varies in an axial direction. The fact that the distance between the roll press 11, 12 and the surface of the tearer 5 varies over the axial extent of the tearer means that the time spent by fiber threads in the housing 6 before they are encountered by the tearer 5 will also vary depending on where over the width the fiber threads are fed into the housing 6, that is to say the inlet feed position of the fiber threads in relation to the tearer 5.

Another way of producing fiber length variations is to use separate air flows in order to actively control the length of time that the fiber threads spend in the housing 6 before the teeth of the tearer 5 get hold of the fiber threads. The control can be exercised by means of air jets arranged in the upper part of the housing 6, air flows being created which are superimposed on air flows caused by rotation of the tearer 5. The tow rope is thereby deflected so that the time which the fiber threads spend in the housing 6 before being encountered by the teeth of the tearer 5 is adjusted. Jets can be arranged so that only a limited part of the width of the tow rope is guided, whilst other parts are not guided. It is also possible to arrange a plurality of jets providing air flows in different directions, certain jets guiding certain parts of the width of the tow rope, so that the time spent before contact with the teeth of the tearer 5 is reduced, and other jets providing air flows which prolong the time spent.

A further advantage of additional deflection air from jets as described above is that it also has a cooling effect on the equipment.

It has been shown that the method described above for producing airborne fibers from tow rope and air-depositing the fibers, produces air-deposited fiber layer with a very well defined distribution of fibers in the layer. Furthermore, very few if any flocks occur in the layer. The method described is very easy to perform in comparison with the present carding technique. It is not entirely clear why the method described leads to such a good result. One contributory reason, however, is probably the fact that an effective separation of the fibers occurs at the instant of tearing and that the fibers are thereafter kept separate from one another until the fiber layer is created. Another contributory reason may be that, because the threads are stretched before the fibers are torn off, each fiber torn off has, from the outset, a well defined direction perpendicular to the direction of rotation of the tearer. Furthermore, the interval between the tearings may reduce the risk of fibers subsequently torn off catching in fibers torn off earlier and forming flocks.

Various additional material can easily be mixed into a fiber layer manufactured by the method described. Examples of additional material are other grades of fibers, highly absorbent gel-forming polymers in granulate form, so-called super-absorbent materials or the like. The admixture is suitably undertaken after the fibers have passed through the tearer, in connection with the air flow that is generated by the blower 9. The admixture can be arranged anywhere between the blower 9 and the mat former 3.

The embodiment described can naturally be modified without departing from the scope of the invention. For example, the tow rope may be arranged in some way other than on a storage reel, for example laid in a container. The ribs on the rollers forming part of the roll press may have some other cross-section, the tops, for example, being advantageously rounded. The air flow may be produced by means of a vacuum instead of a blower. The housing that encloses the tearer may have another shape, being designed, for example, to narrow towards the air outlet. Furthermore, other types of tearers may be used, and the roll press may be designed in some other way in order to hold the tow rope securely fast in its roll nip, being designed, for example, to press the tow-rope against the periphery of one of the rollers in the roll press, in order to increase the bearing surface of the tow rope against this roller. In addition, the roll press may advantageously be displaceably supported so that the distance between the rollers and the periphery of the tearer is adjustable. It is also possible to provide the rollers and the tearer with a width such that a plurality of tow ropes arranged side by side with one another can pass through the arrangement simultaneously. The invention must therefore only be limited by the content of the claims attached.

Although only preferred embodiments are specifically illustrated and described herein, it will be appreciated that many modifications and variations of the present invention are possible in light of the above teachings and within the purview of the appended claims without departing from the spirit and intended scope of the invention.

The invention claimed is:

1. A process for producing a flow of airborne fibers, the process comprising:

a) feeding continuous fibers in a thread bundle from a stock of fiber material through a roll press which rotates at a rate of feed and with the thread bundle held fast in a nip between rollers of the roll press;

b) breaking the continuous fibers into individual fiber lengths by means of a tearer as the continuous fibers emerge from the roll press; and c) carrying away the individual fiber lengths that are broken off by the tearer by means of an air flow;

wherein the tearer comprises a rotating tearer and wherein an axis of rotation of the tearer is transverse to a feed path of the thread bundle, as the thread bundle contacts the rotating tearer.

2. The process according to claim 1, wherein the tearer comprises a rotating tearer and that the tearer is rotated at a peripheral speed greater than 600 m/min.

3. The process according to claim 2, wherein a length of the airborne fiber lengths is adjusted by varying a distance between the roll press and the tearer.

4. The process according to claim 3, wherein a quantity of airborne fiber lengths is adjusted by varying the speed of rotation of the roll press.

5. The process according to claim 2, wherein a quantity of airborne fiber lengths is adjusted by varying the speed of rotation of the roll press.

6. The process according to claim 1, wherein the tearer comprises a rotating tearer and that the tearer is rotated at a peripheral speed greater than 1200 m/min.

7. The process according to claim 1, wherein the tearer comprises a rotating tearer and that the tearer is rotated at a peripheral speed greater than 1500 m/min.

8. The process according to claim 1, wherein the tearer comprises a plurality of teeth and the breaking step is accomplished by engaging the fiber material with the plurality of teeth.

9. An arrangement for producing airborne fibers having a defined length distribution from continuous fibers in a thread bundle, the arrangement comprising:

a roll press with an inlet side for the continuous fibers and an outlet side;

a tearer arranged adjacent to the outlet side of the roll press;

a housing which encloses the tearer and which comprises an opening on a side facing the outlet side of the roll press; and elements for producing an air flow through the housing;

wherein the tearer comprises a rotatable tearer and wherein an axis of rotation of the tearer is transverse to a direction of a line through the housing opening on a side facing the outlet side of the roll press.

10. The arrangement according to claim 9, further comprising a stock of the continuous fibers.

11. The arrangement according to claim 9, wherein the elements for producing an air flow through the housing comprise an air inlet and an air outlet arranged at opposite sides of the housing, and an element for generating an air flow through the housing from the air inlet to the air outlet.

12. The arrangement according to claim 11, wherein the roll press includes rollers having a series of axial ribs evenly distributed along a circumference of the rollers and extending over an entire length of the rollers, the ribs on one of the rollers engaging in intervals between the ribs on a second of the rollers as the rollers rotate.

13. The arrangement according to claim 11, wherein the tearer comprises a rotating tear roller.

14. The arrangement according to claim 11, wherein the element for generating an air flow through the housing from the air inlet to the air outlet comprises a blower, an outlet side of which is connected to the air inlet of the housing.

15. The arrangement according to claim 9, wherein the roll press includes rollers having a series of axial ribs evenly distributed along a circumference of the rollers and extending over an entire length of the rollers, the ribs on one of the rollers engaging in intervals between the ribs on a second of the rollers as the rollers rotate.

16. The arrangement according to claim 15, wherein the tearer comprises a rotating tear roller.

17. The arrangement according to claim 9, wherein the tearer comprises a rotating tear roller.

18. The arrangement according to claim 17, wherein the arrangement further comprises elements for moving the roll press radially in relation to the tear roller.

19. The arrangement according to claim 9, wherein the tearer comprises a plurality of teeth.

20. The arrangement according to claim 19, wherein the plurality of teeth extend circumferentially about the tearer.

21. A process for producing a flow of airborne fibers, the process comprising:

a) feeding continuous fibers in a thread bundle from a stock of fiber material through a roll press which rotates at a rate of feed and with the thread bundle held fast in a nip between rollers of the roll press;

b) breaking the continuous fibers into individual fiber lengths by means of a tearer as the continuous fibers emerge from the roll press; and c) carrying away the individual fiber lengths that are broken off by the tearer by means of an air flow;

wherein the continuous fibers are broken so as to provide a distribution of different individual fiber lengths without changing process conditions or apparatus settings.

22. The process of claim 21 wherein approximately 25% of a total proportion of the individual fiber lengths broken from the continuous fibers are 5–40 mm in length, approximately 50% of a total proportion of the individual fiber lengths broken from the continuous fibers are 40–70 mm in length, and approximately 25% of a total proportion of the individual fiber lengths broken from the continuous fibers are 70–150 mm in length.

* * * * *